US005439389A

United States Patent [19]

Cheng et al.

[11] Patent Number: 5,439,389

[45] Date of Patent: Aug. 8, 1995

[54] STRUCTURE OF LAMP SOCKET

[76] Inventors: You-Jen Cheng; Tzu-Ling Cheng, both of 2nd Fl., 18-9, Tienmu W. Road, Taipei City, Taiwan

[21] Appl. No.: 247,715

[22] Filed: May 23, 1994

[51] Int. Cl.[6] ..... H01R 4/24

[52] U.S. Cl. ..... 439/419; 439/434; 439/615

[58] Field of Search ..... 439/611–619, 439/702–707, 699, 638, 417–419, 395, 434

[56] References Cited

U.S. PATENT DOCUMENTS

| | | | |
|---|---|---|---|
| 2,800,635 | 7/1957 | Christenberry | 439/419 |
| 3,422,393 | 1/1969 | Plagge | 439/613 |
| 5,350,315 | 9/1994 | Ching et al. | 439/419 |

*Primary Examiner*—David L. Pirlot
*Attorney, Agent, or Firm*—Ladas & Parry

[57] ABSTRACT

A lamp socket of the type having a first contact metal plate and a second contact metal plate fastened to a socket body thereof, and a socket cap fastened to the socket body to hold down an electric wire causing the first and second contact metal plates made a respective electric contact with either conductor of the electric wire, wherein a contact metal socket is fastened to the socket body on the inside through a screw joint to hold the lamp bulb, causing the ring contact of the lamp bulb electrically connected to the second contact metal plate and permitting the tip contact of the lamp bulb to extend out of a hole on the contact metal socket and to make an electric contact with the first contact metal plate, the contact metal socket having a serrated outward flange at the bottom engaging the inside wall of the socket body to secure the connection between the socket body and the contact metal socket.

1 Claim, 3 Drawing Sheets

STRUCTURE OF LAMP SOCKET

BACKGROUND OF THE INVENTION

The present invention relates to lamp sockets, and more particularly to a such a lamp socket having a metal socket fixed to the socket shell thereof to hold the lamp bulb in making an electric contact Various decorative strings and Christmas tree light sets are well-known and intensively used western countries as well as most Asian countries during Christmas holidays. When installed, decorative strings and Christmas tree light sets are controlled to flash and to give different colors of light. In recent days, the requirement for a safety operation on decorative lighting devices has become more and more critical. UL and CSA define strict specifications on these products. The lamp socket for a decorative string or Christmas tree light set, as shown in FIG. 3, is generally comprised of an internally threaded plastic socket body 1 having a first contact metal plate 6 and a second contact metal plate 14 mounted on the inside. The socket body 1 has a wire groove 11 on the top end thereof for mounting the electric wire 5, and two slots 13 through which the top end of either contact metal plate projects. The contact metal plates 6 and 14 have each a beveled top edge projecting out of either slot 13 into the wire groove 11. When the electric wire 5 is placed in the wire groove 11, a plastic socket cap 3 is fastened to the socket body 1 to hold down the electric wire 5 causing the beveled top edges of the contact metal plates 6 and 14 pierced the insulator of either conductor of the electric wire 5 to make a respective electric contact. The first contact metal plate 6 has a curved bottom end transversely disposed inside the socket body 1 at the top and stopped between two ribs 15. When the base 41 of the lamp bulb 4 is threaded into the socket body 1, the tip and ring contacts of the lamp bulb 4 are respectively connected to the conductors of the electric wire 5 through the contact metal plates 6 and 14. This structure of lamp socket is functional however, it has drawbacks. The major drawback of this structure of lamp socket is that the socket body 1 may expand when hot, causing a gap produced between the base 41 of the lamp bulb 4 and the threaded inside wall of the socket body 1. Therefore, an electric shock may occur when one touches the lamp bulb 4.

SUMMARY OF THE INVENTION

The present invention has been accomplished to provide a lamp socket which eliminates the aforesaid problem. According to the present invention, a contact metal socket is fastened to the socket body on the inside through a screw joint to hold the lamp bulb, causing the ring contact of the lamp bulb electrically connected to the second contact metal plate and permitting the tip contact of the lamp bulb to extend out of a hole on the contact metal socket and to make an electric contact with the first contact metal plate. The contact metal socket has a serrated outward flange at the bottom engaging the inside wall of the socket body to secure the connection between the socket body and the contact metal socket.

BRIEF DESCRIPTION OF THEE DRAWINGS

DETAILED DESCRIPTION OF THE PREFERRED EMBODIMENT

Figure 1:
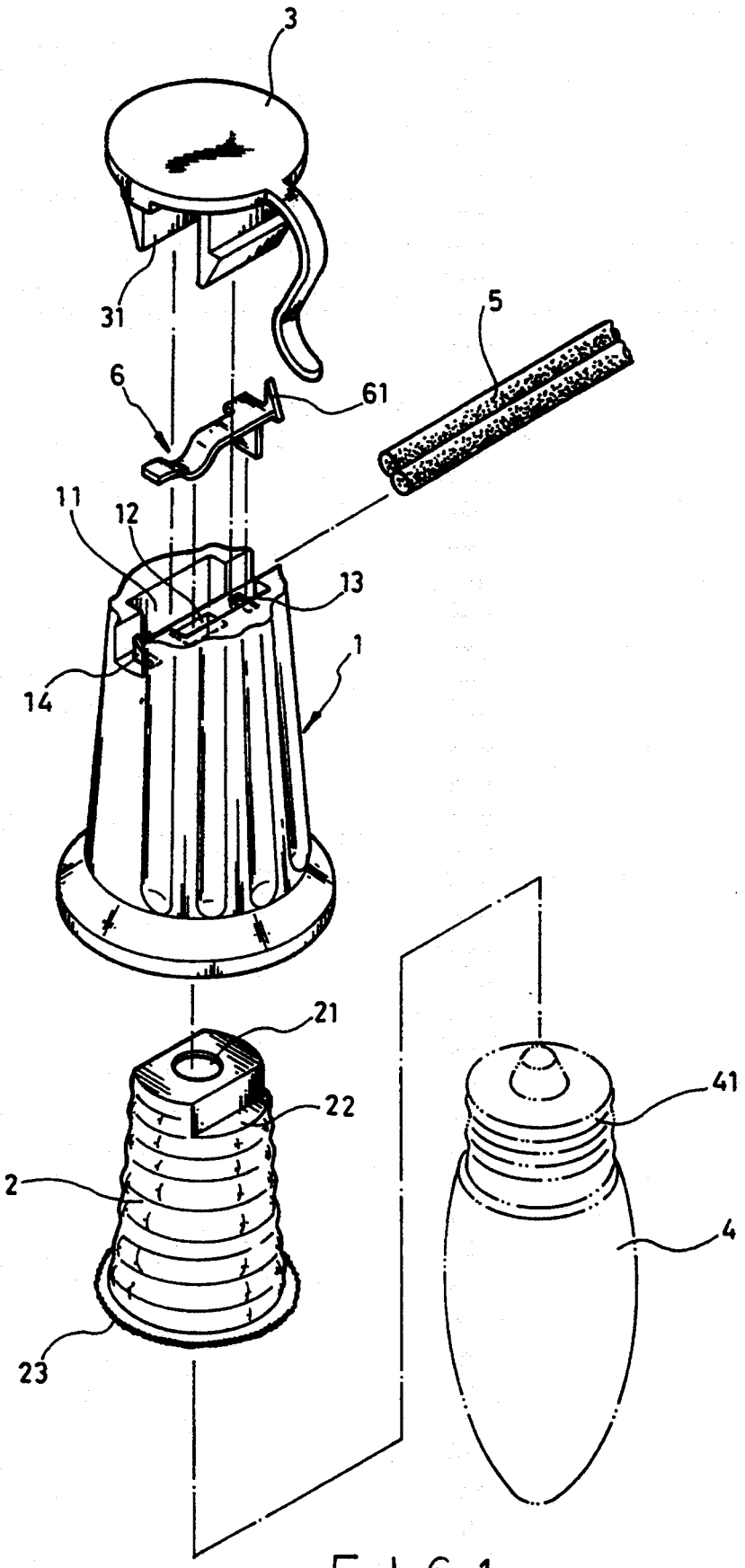
FIG. 1 is an exploded view of a lamp socket according to the present invention.
Figure 2:
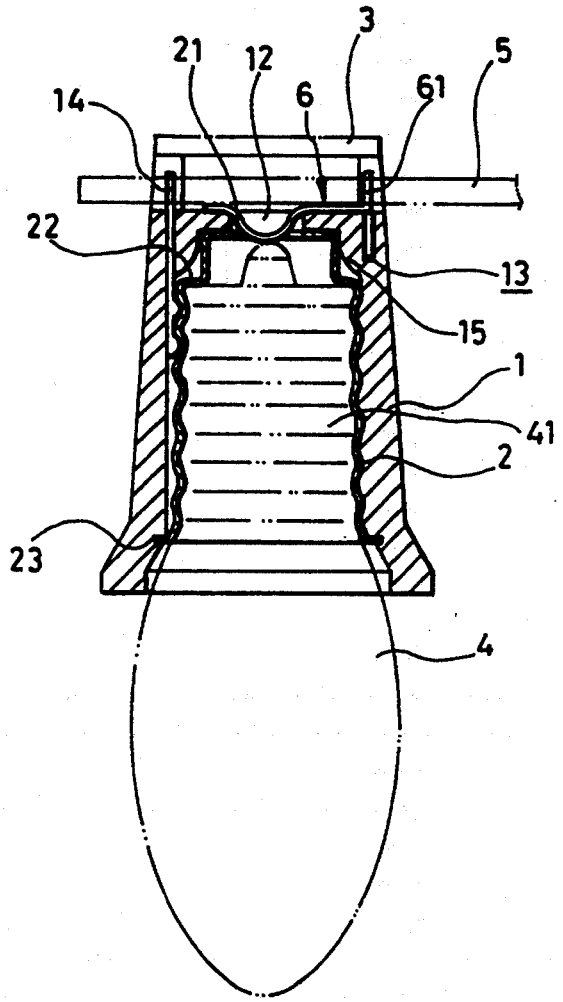
FIG. 2 is a longitudinal view in section of the lamp socket shown in FIG. 1.
Figure 3:
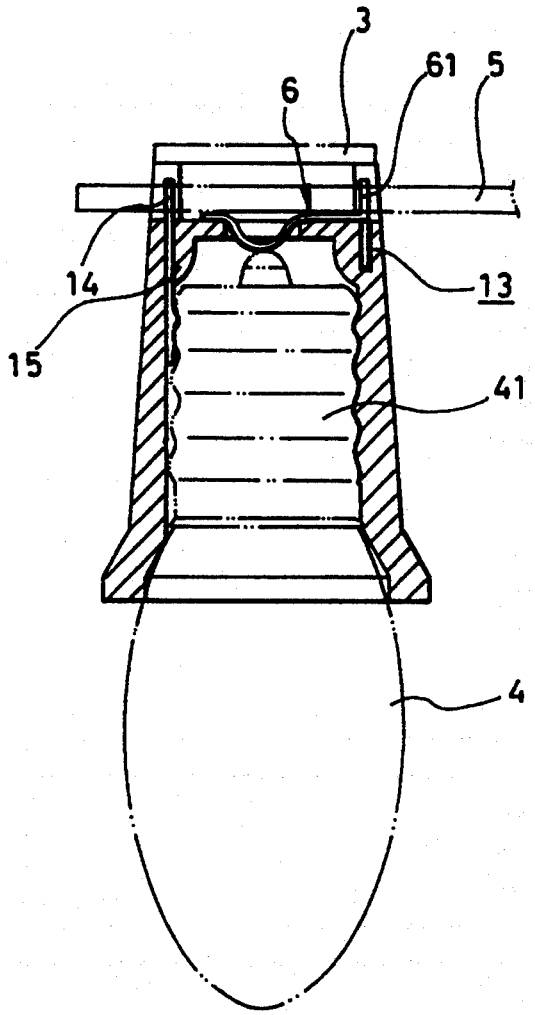
FIG. 3 (PRIOR ART)
FIG. 3 is a longitudinal view in section of a lamp socket according to the prior art.

Referring to FIGS. 1 and 2, a lamp socket in accordance with the present invention comprises mainly a socket body 1, a contact metal socket 2, a socket cap 3, and a first contact metal plate 6, and a second contact metal plate 14. The socket body 1 comprises a wire groove 11 on the top end thereof for mounting an electric wire 5, two slots 13 through the wire groove 11 at two opposite sides for passing the first and second contact metal plates 6 and 14 respectively, a center through hole 12 through the wire groove 11 at the center, and two spaced ribs 15 raised from the inside wall thereof. The socket cap 3 is fastened to the socket body 1 to hold down the electric wire 5 in the wire groove 11, having two bottom hooks 31 respectively hooked in respective retaining holes (not shown) on the socket body 1. The first and second contact metal plates 6 and 14 are respectively disposed inside the socket body 1, having each a beveled projection 61 extended out of either slot 13 and pierced the insulator of either conductor of the electric wire 5 to make a respective electric contact. The contact metal socket 2 is internally threaded for holding a lamp bulb 4 and fastened to the socket body 1 through a screw joint and electrically connected to the second contact metal plate 14, having a through hole 21 on the top end thereof spaced below the first contact metal plate 6, two recessed portions 22 bilaterally made on the top end thereof respectively engaged with the ribs 15, and a serrated outward flange 23 around the border of the bottom end thereof. When the contact metal socket 2 is fastened to the socket body 1, the serrated outward flange 23 engages the inside wall of the socket body 1 to secure the connection between the socket body 1 and the contact metal socket 2. When the base 41 of the lamp bulb 4 is threaded into the contact metal socket 2, the tip contact of the lamp bulb 4 extends out of the through hole 21 to contact the first contact metal plate 6, and at the same time the ring contact of the lamp bulb 4 is electrically connected to the second contact metal plate 14 through the contact metal socket 2.

What is claimed is:

1. A lamp socket of the type having an internally threaded socket body having a wire groove, a socket cap fastened to said socket body to hold down an electric wire in said wire groove, a first contact metal plate and a second contact metal plate respectively fastened in a respective hole on said socket body and having each a top end connected to either conductor of said electric wire and a bottom end disposed inside said socket body, the improvement comprising a contact metal socket fastened to said socket body on the inside through a screw joint and electrically connected to said second contact metal plate, said contact metal socket comprising a through hole on a top end thereof spaced below said first contact metal plate, two recessed portions bilaterally made on the top end thereof respectively engaged with a respective rib on said socket body, a spiral groove around an inside wall thereof for fastening the base of a lamp bulb permitting the tip contact of said lamp bulb to extend out of the through hole of said contact metal socket and to electrically contact said first contact metal plate and permitting the ring contact of said lamp bulb to electrically connected to said second contact metal plate through said contact metal socket, and a serrated outward flange disposed around the border of a bottom end thereof and engaging the inside wall of said socket body.

* * * * *